US006609952B1

(12) United States Patent
Simon

(10) Patent No.: US 6,609,952 B1
(45) Date of Patent: Aug. 26, 2003

(54) CHEMICAL MECHANICAL PLANARIZATION (CMP) SYSTEM AND METHOD FOR DETERMINING AN ENDPOINT IN A CMP OPERATION

(75) Inventor: Joseph P. Simon, Newark, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/109,902

(22) Filed: Mar. 29, 2002

(51) Int. Cl.[7] ..... B24B 49/00

(52) U.S. Cl. ..... 451/6; 451/8; 451/287; 451/296

(58) Field of Search ..... 451/287, 285, 451/296, 6, 8, 36, 60

(56) References Cited

U.S. PATENT DOCUMENTS 6,117,779 A * 9/2000 Shelton et al. ..... 438/692
6,261,851 B1 * 7/2001 Li et al. ..... 438/8
6,287,171 B1 * 9/2001 Meloni ..... 451/5

* cited by examiner

*Primary Examiner*—Dung Van Nguyen
(74) *Attorney, Agent, or Firm*—Martine & Penilla, LLP

(57) ABSTRACT

In a method for determining an endpoint in a chemical mechanical planarization (CMP) operation, the concentration of an oxidizing agent in the slurry byproduct generated during the CMP operation is monitored. The endpoint of the CMP operation is determined based on the concentration of the oxidizing agent in the slurry byproduct. The concentration of the oxidizing agent in the slurry byproduct may be monitored by diverting the slurry byproduct from a surface of a polishing pad, and measuring an optical property of the slurry byproduct diverted from the surface of the polishing pad. A CMP system configured to implement the method for determining an endpoint also is described.

14 Claims, 3 Drawing Sheets

CHEMICAL MECHANICAL PLANARIZATION (CMP) SYSTEM AND METHOD FOR DETERMINING AN ENDPOINT IN A CMP OPERATION

BACKGROUND OF THE INVENTION

The present invention relates generally to semiconductor fabrication and, more particularly, to a system and method for determining an endpoint in the chemical mechanical planarization of thin films, particularly metal films comprised of copper.

In the fabrication of semiconductor devices, chemical mechanical planarization (CMP) is used to planarize globally the surface of an entire semiconductor wafer. CMP is often used to planarize metallization layers, which are formed of conducting metals, e.g., aluminum and copper. To obtain consistent results as well as to avoid damaging the underlying circuit components, the endpoint of the CMP operation must be carefully monitored.

A variety of approaches have been used to detect an endpoint in the CMP of metallization layers. Direct methods of determining an endpoint use an external signal source or a chemical agent to determine the physical state of the wafer surface during the CMP operation. In such direct methods, the wafer surface has been monitored using acoustic wave velocity, optical reflectance and interference, impedance/conductance, and electrochemical potential change due to the introduction of specific chemical agents.

Indirect methods of determining an endpoint monitor a signal that is internally generated within the tool due to physical or chemical changes that occur naturally during the CMP operation. In such indirect methods, the following parameters have been monitored: the temperature of the polishing pad/wafer surface; the vibration of the planarization tool; the frictional forces between the polishing pad and the polishing head; the electrochemical potential of the slurry; and acoustic emissions.

The indirect methods of determining an endpoint are strongly dependent on the process parameters and the selection of consumables. Consequently, with the exception of friction sensing, none of the indirect methods has been widely used in the industry. Of the direct methods of determining an endpoint, a number of the optical methods have been used in the industry. One drawback of these optical methods, however, is that they do not provide a global indication of the state of the removal of the metal from the surface of the wafer. Instead, these optical methods detect the removal of metal from only a single localized area of the wafer.

In view of the foregoing, there is a need for a method that can reliably determine the endpoint in a CMP operation based on the state of the film removal over the entire surface of the wafer.

SUMMARY OF THE INVENTION

Broadly speaking, the present invention fills this need by providing a method for determining the endpoint in a chemical mechanical planarization (CMP) operation based on the concentration of an oxidizing agent in the slurry byproduct. The present invention also provides a CMP system configured to implement the method for determining an endpoint.

In accordance with one aspect of the present invention, a method for determining an endpoint in a CMP operation is provided. In this method, a concentration of an oxidizing agent in a slurry byproduct generated during a CMP operation is monitored. The endpoint of the CMP operation is determined based on the concentration of the oxidizing agent in the slurry byproduct. In one embodiment, when the concentration of the oxidizing agent in the slurry byproduct increases to a predetermined level, the CMP operation is stopped.

In one embodiment, the CMP operation is conducted on a metal film comprised of copper, and the oxidizing agent is comprised of hydrogen peroxide. In other embodiments, different oxidizing agents are used. By way of example, the oxidizing agent may be comprised of a material selected from the group consisting of HCl, nitric acid, hydroxylamine, $KMnO_4$, and $KIO_3$.

In one embodiment, the operation of monitoring the concentration of the oxidizing agent in the slurry byproduct includes diverting the slurry byproduct from a surface of a polishing pad, and measuring an optical property of the slurry byproduct diverted from the surface of the polishing pad. In one embodiment, the optical property of the slurry byproduct is measured with a refractometer. In one embodiment, the slurry byproduct is diverted from the surface of the polishing pad by a slurry diverter that is disposed downstream of a polishing head by a distance in a range from about 3 inches to about 5 inches. As used herein, the term "about" means that the parameter specified can be varied within an acceptable manufacturing tolerance, e.g. , ±10%.

In accordance with another aspect of the present invention, a CMP system is provided. The CMP system may be either a linear CMP system or a rotary CMP system. In the case of a linear CMP system, the CMP system includes a pair of drums. Each of the pair of drums is configured to rotate. A polishing pad is disposed around the pair of drums. A polishing head, which is configured to hold a semiconductor wafer, is disposed above a top surface of the polishing pad. The CMP system further includes a slurry dispenser, e.g. a slurry bar, for dispensing a slurry onto the top surface of the polishing pad and a slurry diverter for diverting a slurry byproduct from the top surface of the polishing pad. A slurry catcher for receiving the slurry byproduct diverted from the top surface of the polishing pad is disposed adjacent to the polishing pad. An optical measuring tool for measuring an optical property of the slurry byproduct also is provided.

In the case of a rotary CMP system, the polishing pad is disposed on a tabletop that is configured to rotate, and the slurry dispenser may be a single nozzle of a flow of slurry emanating from the middle of the tabletop. The slurry diverter, the slurry catcher, and the optical measuring tool may be configured relative to the polishing pad in substantially the same manner described for a linear CMP system.

In one embodiment, the optical measuring tool is a refractometer. In one embodiment, the distance the slurry diverter is disposed away from the polishing head is in a range from about 3 inches to about 5 inches. In one embodiment, the slurry catcher is comprised of a substantially transparent material, and the optical measuring tool is disposed below the slurry catcher.

The CMP system and method of the present invention advantageously enable the endpoint of a CMP operation to be determined by monitoring the concentration of an oxidizing agent in the slurry byproduct. The method is well suited for use in the CMP of copper films because it is passive, nondestructive, and does not require light, which can have adverse effects on copper, to come into contact with the copper film. In addition, in contrast with optical methods that detect the state of film removal on only a single localized area, the method of the present invention monitors the state of film removal over the entire surface of the wafer.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Several exemplary embodiments of the invention will now be described in detail with reference to the accompanying drawings.

The present invention provides a system and method for determining an endpoint in a chemical mechanical planarization (CMP) operation based on the concentration of an oxidizing agent in the slurry byproduct. As used in connection with the description of the invention, the term "slurry byproduct" refers to the used slurry material, i.e., the slurry material that remains after the slurry has contacted the thin film being planarized at the polishing surface.

Figure 1:
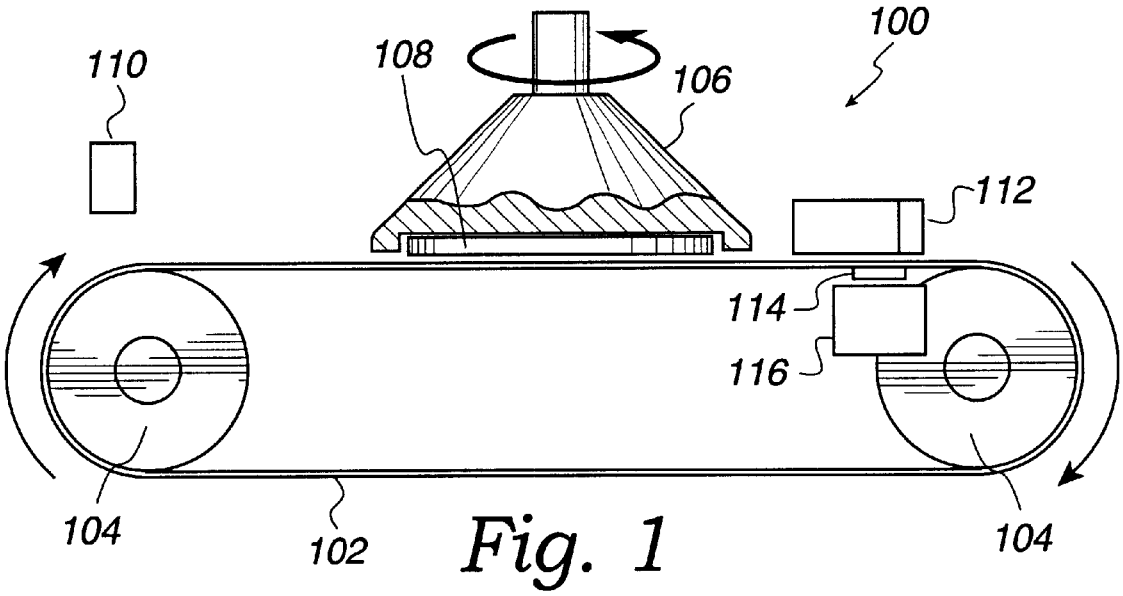
FIG. 1 is a simplified schematic diagram of a linear chemical mechanical planarization (CMP) system in accordance with one embodiment of the invention.

FIG. 1 is a simplified schematic diagram of linear CMP system 100 in accordance with one embodiment of the invention. As shown therein, CMP system 100 includes polishing pad 102, which is in the form of a belt that is disposed around rotating drums 104. Polishing head 106 is disposed above the top surface of polishing pad 102 and is configured to hold semiconductor wafer 108 in place during processing. Slurry dispenser 110 dispenses slurry onto the top surface of polishing pad 102. In one embodiment, slurry dispenser 110 is a slurry manifold (sometimes referred to as a slurry bar) that is configured to dispense slurry across the top surface of polishing pad 102. As polishing pad 102 moves (e.g., in the direction of the arrows shown in FIG. 1), polishing head 106 rotates (e.g., in the direction of the arrow shown in FIG. 1) and lowers wafer 108 onto the top surface of the polishing pad. The platen assembly that supports polishing pad 102 during the CMP operation has been omitted from FIG. 1 for ease of illustration. Those skilled in the art are familiar with the details and operation of linear CMP systems. By way of example, the foregoing components, i.e., polishing pad 102, drums 104, polishing head 106, and slurry dispenser 110, may be the same as used in the TERES™ CMP system, which is commercially available from Lam Research Corporation of Fremont, California (the assignee of this application).

With continuing reference to FIG. 1, slurry diverter 112 is provided just after, i.e., downstream from, polishing head 106. Slurry diverter 112 is disposed just above the top surface of polishing pad to divert the slurry byproduct therefrom, as will be explained in more detail later. Slurry diverter 112 may be formed of any suitable material that does not react significantly with the slurry or the slurry byproduct. In this regard, it is noted that alumina-based slurries are typically used in the CMP of copper films. Slurry catcher 114 is disposed adjacent to polishing pad 102 to receive the slurry byproduct diverted by slurry diverter 112. Slurry catcher 114 may be formed of any suitable material that does not react significantly with the slurry or the slurry byproduct. In one embodiment, slurry catcher 114 is comprised of a clear, i.e., substantially transparent, plastic material such as, for example, polyethylene terephthalate (PET). Optical measuring tool 116 is disposed below slurry catcher 114. In one embodiment, optical measuring tool 116 is a refractometer. By way of example, one suitable refractometer is the Model RefracDS process refractometer, which is commercially available from Rosemount Analytical Inc., Uniloc Division, of Irvine, Calif. The AR200 Auto Replenisher System, which is commercially available from BOC Edwards of Wilmington, Mass., also includes a suitable refractometer. Additional details regarding slurry diverter 112, slurry catcher 114, and optical measuring tool 116 are described below with reference to FIG. 2.

Figure 2:
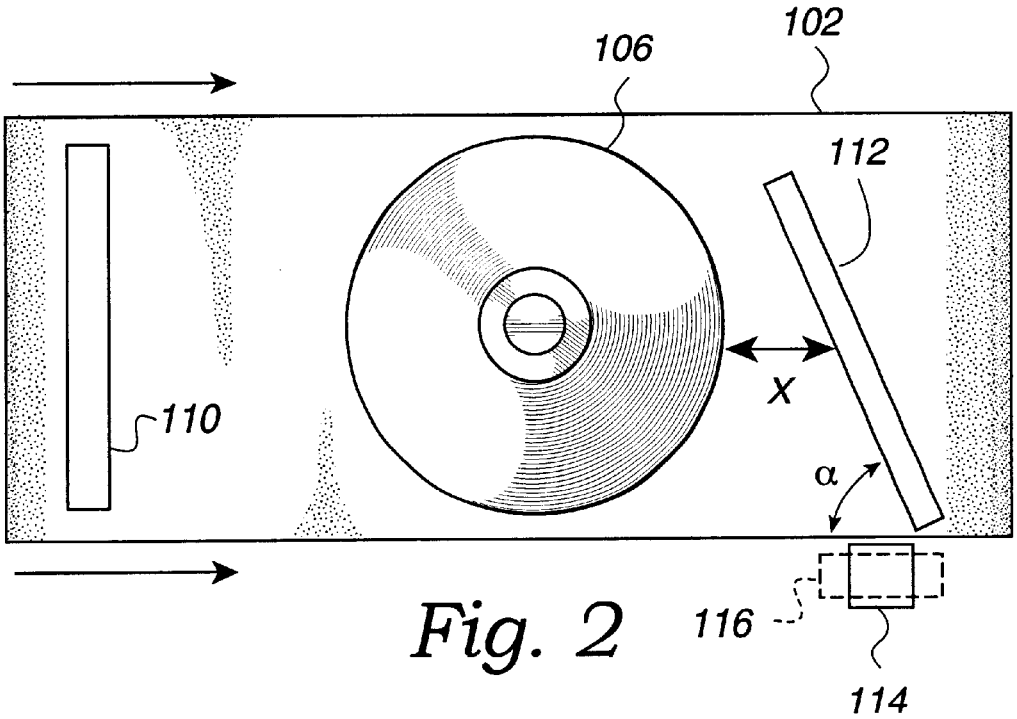
FIG. 2 is a simplified top plan view of the linear CMP system shown in FIG. 1.

FIG. 2 is a top plan view of linear CMP system 100 shown in FIG. 1. As shown in FIG. 2, slurry diverter 112 is disposed a distance, X, downstream from polishing head 106. This distance is preferably as short as is practical so that the CMP operation can be stopped as quickly as possible, as will be explained in more detail later. In one embodiment, the distance, X, is in the range from about 3 inches to about 5 inches. Slurry diverter 112 may be disposed at an angle, $\alpha$, relative to the outer edge of polishing pad 102 so that the slurry byproduct can be smoothly and efficiently diverted from the polishing pad. The angle, $\alpha$, may be any suitable angle, but is preferably in the range from about 30 degrees to about 60 degrees. In one embodiment, the angle, $\alpha$, is about 45 degrees. Slurry catcher 114 is configured to receive the slurry byproduct diverted from polishing pad 102 and to channel the slurry byproduct to an appropriate waste receptacle. Optical measuring tool 116 is disposed below slurry catcher 114 so that the optical measuring tool can measure an optical property of the slurry byproduct just as the slurry byproduct leaves polishing pad 102. As noted above, slurry catcher 114 may be formed of a substantially transparent material so that optical measuring tool 116 can measure the optical property of the slurry byproduct through the slurry catcher.

To begin a CMP operation, slurry dispenser 110 dispenses slurry onto polishing pad 102. As noted above, alumina-based slurries are typically used in the CMP of copper films. The alumina-based slurries include an oxidizing agent as well as other chemicals to maintain pH and other characteristics. The oxidizing agent is provided to oxidize the copper film so that such film can be removed by polishing pad 102. The oxidizing agent most commonly used in slurries for the CMP of copper films is hydrogen peroxide ($H_2O_2$), but other suitable oxidizing agents that react with copper without damaging the existing copper film also may be used. By way of example, other oxidizing agents that may be suitable for use include HCl, nitric acid, hydroxylamine, $KMnO_4$, and $KIO_3$.

Once the slurry has been dispensed onto polishing pad 102, polishing head 106 rotates and lowers wafer 108 onto the top surface of the polishing pad. In the CMP of a copper film using hydrogen peroxide as the oxidizing agent, the reaction between copper and hydrogen peroxide is as follows: $Cu+H_2O_2 \rightarrow CuO+H_2O$. At the start of the CMP operation, the hydrogen peroxide in the slurry will react with the copper film to oxidize the copper film. Consequently, the concentration of hydrogen peroxide in the slurry byproduct will be relatively small. As the copper film is removed during the CMP operation, however, the concentration of hydrogen peroxide in the slurry byproduct will increase because there is less of the copper film to react with the hydrogen peroxide. This increase in the concentration of hydrogen peroxide (or other oxidizing agent) in the slurry byproduct can be used to control the polishing time of the CMP operation, as will be described below.

To monitor the concentration of hydrogen peroxide (or other oxidizing agent) in the slurry byproduct, slurry diverter 112 diverts the slurry byproduct from polishing pad 102 immediately after the slurry byproduct exits the polishing surface. As slurry catcher 114 receives the slurry byproduct, optical measuring tool 116 measures an optical property of the slurry byproduct. In one embodiment, optical measuring tool 116 is a refractometer. In this embodiment, the data obtained by the refractometer is used to determine the concentration of hydrogen peroxide in the slurry byproduct. This may be accomplished by conducting a suitable calibration operation in which data obtained by the refractometer is correlated to the hydrogen peroxide concentration determined by conventional titration analysis, which is well known to those skilled in the art. Once the calibration operation has been completed, the data obtained by the refractometer can be used to determine the concentration of hydrogen peroxide in the slurry byproduct instantaneously.

To determine the endpoint of the CMP operation, i.e., the point at which a desired thickness of the thin film has been removed, the concentration of hydrogen peroxide (or other oxidizing agent) in the slurry byproduct is monitored to determine when the concentration has increased to a level that indicates that the endpoint has been reached. The concentration of hydrogen peroxide in the slurry byproduct that indicates that the endpoint of the CMP operation has been reached may be determined by conducting a suitable calibration operation in which the amount of the thin film removed during the CMP operation is correlated to the concentration of hydrogen peroxide in the slurry byproduct.

Figure 3:
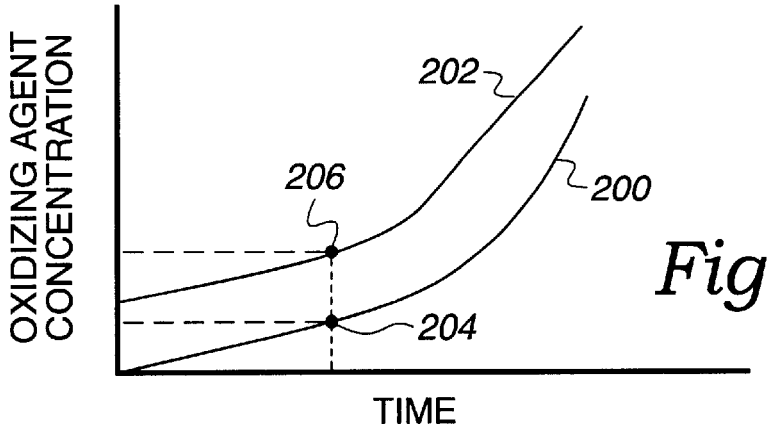
FIG. 3 is a graph of oxidizing agent concentration in the slurry byproduct versus time for two exemplary CMP operations.

FIG. 3 is a graph of oxidizing agent concentration in the slurry byproduct versus time for two exemplary CMP operations. Curve 200 corresponds to a CMP operation in which the amount of oxidizing agent in the slurry is such that the slurry byproduct contains virtually no oxidizing agent at the start of the CMP operation. In this situation, virtually all of the oxidizing agent in the slurry reacts with the metal film at the beginning of the CMP operation. On the other hand, curve 202 corresponds to a CMP operation in which the amount of oxidizing agent in the slurry is such that the slurry byproduct contains a relatively large amount of the oxidizing agent at the start of the CMP operation. In this situation, the initial amount of the oxidizing agent in the slurry exceeds the amount of the oxidizing agent that reacts with the metal film at the beginning of the CMP operation. Point 204 (on curve 200) and point 206 (on curve 202) correspond to the respective oxidizing agent concentrations in the slurry byproduct that indicate that the respective endpoints of the CMP operations have been reached. As shown in FIG. 3, both points 204 and 206 fall at the same polishing time, to indicate that, except for the amount of the oxidizing agent in the slurry, the CMP operations were conducted under identical conditions. It will be apparent to those skilled in the art that the polishing time for a given CMP operation is a function of a variety of parameters, e.g., the type and thickness of material to be removed, the type of slurry used, and the amount of force applied on the wafer.

Those skilled in the art will recognize that there will be a slight time delay associated with the measurement of the concentration of the oxidizing agent in the slurry byproduct. This time delay results from the distance the slurry byproduct must travel from the exit side of polishing head 106 to slurry catcher 114, where optical measuring tool 116 measures an optical property of the slurry byproduct. If desired, an appropriate software program can be used to account for the time delay. When such a software program is used, the CMP operation will be stopped before the concentration of the oxidizing agent in the slurry byproduct reaches the concentration that corresponds to the endpoint of the CMP operation. For a typical CMP operation configured to planarize a copper film, it is believed that the time delay will be about 1 second to about 2 seconds, but may vary from this range depending on the process parameters.

Figure 4:
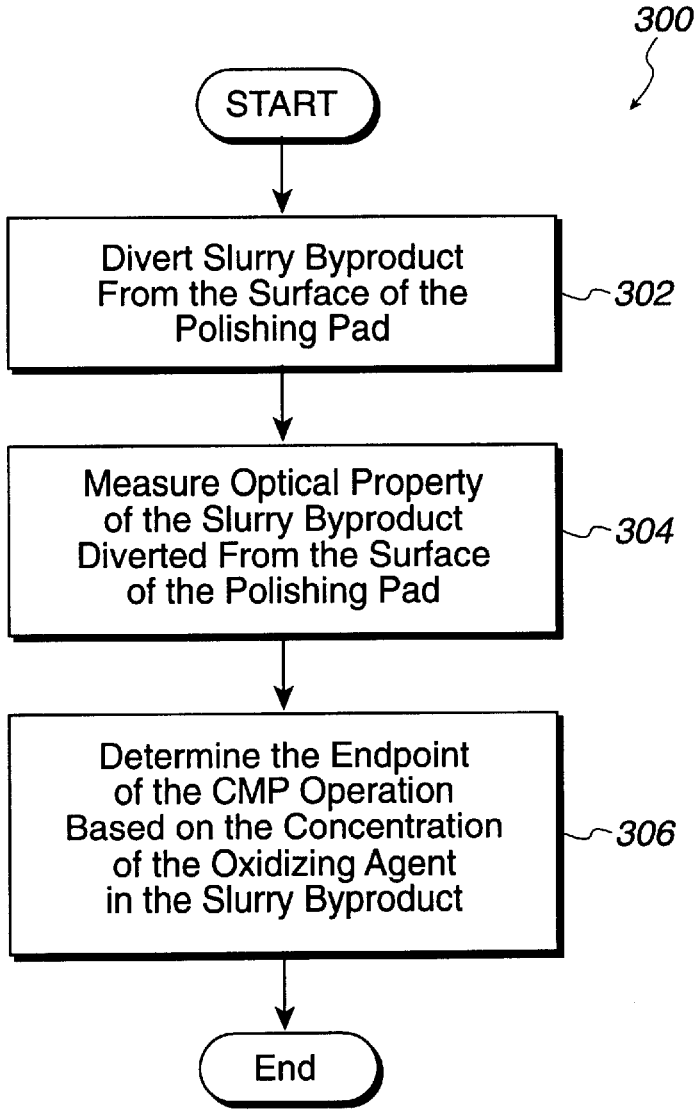
FIG. 4 is a flowchart diagram illustrating the method operations performed in determining an endpoint in a CMP operation in accordance with one embodiment of the invention.

FIG. 4 is a flowchart diagram 300 illustrating the method operations performed in determining an endpoint in a CMP operation in accordance with one embodiment of the present invention. In operation 302, the slurry byproduct is diverted from the surface of the polishing pad. By way of example, the slurry byproduct may be diverted from the surface of the polishing pad using slurry diverter 112 described above with reference to FIGS. 1 and 2. To enable the CMP operation to be stopped as quickly as possible, the slurry diverter should be placed as close to the exit side of the polishing head as is practical. In operation 304, an optical property of the slurry byproduct diverted from the surface of the polishing pad is measured. The optical property is measured to determine the concentration of the oxidizing agent in the slurry byproduct. By way of example, the optical property of the slurry byproduct may be measured using any suitable optical measuring tool, e.g., a refractometer. The data obtained by the optical measuring tool may then be correlated to the concentration of the oxidizing agent in the slurry byproduct as determined by conventional titration analysis, which is well known to those skilled in the art. In this manner, the optical measuring tool can be used to monitor the concentration of the oxidizing agent in the slurry byproduct continuously during a CMP operation.

In operation 306, the endpoint of the CMP operation is determined based on the concentration of the oxidizing agent in the slurry byproduct. The endpoint may be determined by correlating the concentration of the oxidizing agent in the slurry byproduct to the amount of the thin film removed during the CMP operation as determined in a suitable calibration operation. When the concentration of the oxidizing agent in the slurry byproduct increases to a predetermined level, the CMP operation is stopped. In one embodiment, the predetermined level is the concentration that indicates that the desired amount of the thin film has been removed. In another embodiment, the predetermined level is a concentration slightly below the concentration that indicates that the desired amount of the thin film has been removed. In this embodiment, an appropriate software program may be used to account for the time delay associated with the measurement of the concentration of the oxidizing agent in the slurry byproduct. The CMP operation may be stopped by sending an appropriate signal to the process control circuitry that calls for the polishing process to be stopped. In this manner, the polishing time of the CMP operation may be controlled. Once the endpoint has been determined and the CMP operation has been stopped, the method is done.

The CMP system and method of the present invention advantageously enable the endpoint of a CMP operation to be determined by monitoring the concentration of an oxidizing agent in the slurry byproduct. The method is well suited for use in the CMP of copper films because it is passive, nondestructive, and does not require light, which can have adverse effects on copper, to come into contact with the copper film. In addition, in contrast with optical methods that detect the state of film removal on only a single localized area, the method of the present invention monitors the state of film removal over the entire surface of the wafer.

Figure 5:
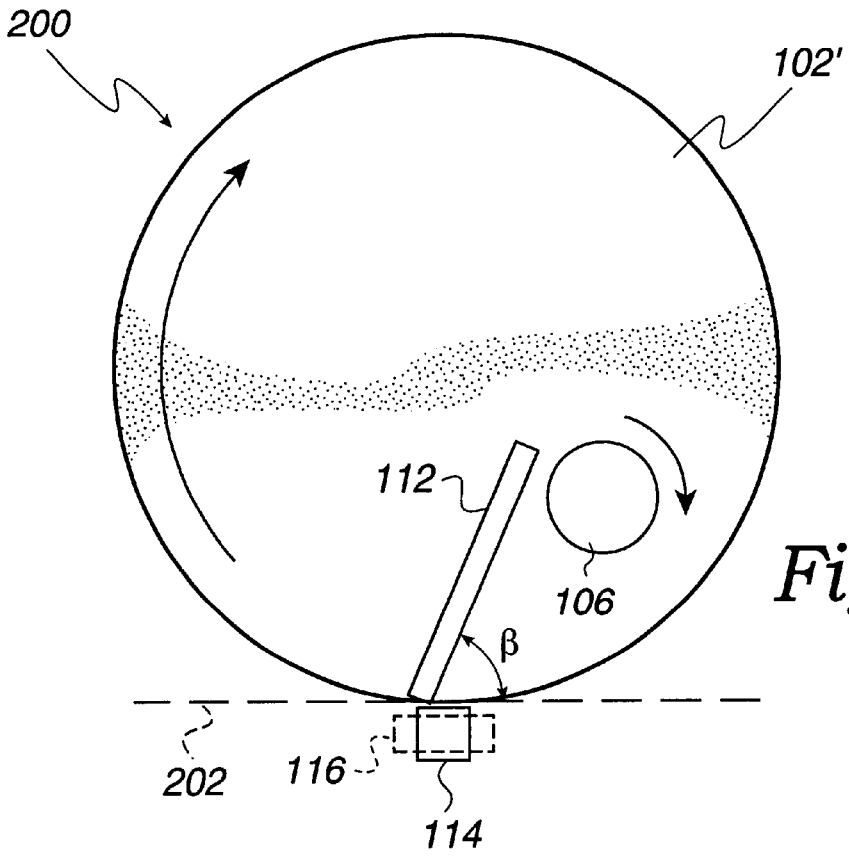
FIG. 5 is a simplified top plan view of an exemplary rotary CMP system in accordance with one embodiment of the invention.

In the foregoing description, the invention has been described with reference to a linear CMP system. It will be apparent to those skilled in the art, however, that the principles of the invention may be incorporated in other CMP systems, e.g., rotary CMP systems. FIG. 5 is a simplified top plan view of an exemplary rotary CMP system 200 in accordance with one embodiment of the invention. As shown in FIG. 5, polishing pad 102' is disposed on a rotating tabletop (not visible in FIG. 5). Slurry diverter 112 is disposed downstream of polishing head 106. Slurry diverter 112 may be disposed at any suitable angle for diverting the slurry byproduct from the top surface of polishing pad 102', e.g., an angle, β, relative to a tangent 202 that intersects the edge of polishing pad 102' at the point where slurry diverter 112 meets the edge of the polishing pad. Slurry catcher 114 is disposed adjacent to polishing pad 102' for receiving the slurry byproduct diverted from the top surface of the polishing pad. Optical measuring tool 116 is disposed below slurry catcher 114.

In summary, the present invention provides a CMP system and a method for determining an endpoint in a CMP operation. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A chemical mechanical planarization system, comprising:

a pair of drums, each of the pair of drums being configured to rotate;

a polishing pad disposed around the pair of drums;

a polishing head disposed above a top surface of the polishing pad, the polishing head being configured to hold a semiconductor wafer;

a slurry dispenser for dispensing a slurry onto the top surface of the polishing pad;

a slurry diverter for diverting a slurry byproduct from the top surface of the polishing pad;

a slurry catcher for receiving the slurry byproduct diverted from the top surface of the polishing pad, the slurry catcher being disposed adjacent to the polishing pad; and an optical measuring tool for measuring an optical property of the slurry byproduct.

2. The chemical mechanical planarization system of claim 1, wherein the optical measuring tool is a refractometer.

3. The chemical mechanical planarization system of claim 1, wherein the slurry dispenser is a slurry bar.

4. The chemical mechanical planarization system of claim 1, wherein a distance the slurry diverter is disposed away from the polishing head is in a range from about 3 inches to about 5 inches.

5. A chemical mechanical planarization system, comprising:

a polishing pad disposed on a tabletop that is configured to rotate;

a polishing head disposed above a top surface of the polishing pad, the polishing head being configured to hold a semiconductor wafer;

a slurry dispenser for dispensing a slurry onto the top surface of the polishing pad;

a slurry diverter for diverting a slurry byproduct from the top surface of the polishing pad;

a slurry catcher for receiving the slurry byproduct diverted from the top surface of the polishing pad, the slurry catcher being disposed adjacent to the polishing pad; and an optical measuring tool for measuring an optical property of the slurry byproduct.

6. The chemical mechanical planarization system of claim 5, wherein the optical measuring tool is a refractometer.

7. The chemical mechanical planarization system of claim 5, wherein a distance the slurry diverter is disposed away from the polishing head is in a range from about 3 inches to about 5 inches.

8. A chemical mechanical planarization system, comprising:

a pair of drums, each of the pair of drums being configured to rotate;

a polishing pad disposed around the pair of drums;

a polishing head disposed above a top surface of the polishing pad, the polishing head being configured to hold a semiconductor wafer;

a slurry dispenser for dispensing a slurry onto the top surface of the polishing pad;

a slurry diverter for diverting a slurry byproduct from the top surface of the polishing pad;

a slurry catcher for receiving the slurry byproduct diverted from the top surface of the polishing pad, the slurry catcher being disposed adjacent to the polishing pad and being comprised of a substantially transparent material; and an optical measuring tool for measuring an optical property of the slurry byproduct, the optical measuring tool being disposed below the slurry catcher.

9. The chemical mechanical planarization system of claim 8, wherein the optical measuring tool is a refractometer.

10. The chemical mechanical planarization system of claim 8, wherein the slurry dispenser is a slurry bar.

11. The chemical mechanical planarization system of claim 8, wherein a distance the slurry diverter is disposed downstream from the polishing head is in a range from about 3 inches to about 5 inches.

12. A chemical mechanical planarization system, comprising:

a polishing pad disposed on a tabletop that is configured to rotate;

a polishing head disposed above a top surface of the polishing pad, the polishing head being configured to hold a semiconductor wafer;

a slurry dispenser for dispensing a slurry onto the top surface of the polishing pad;

a slurry diverter for diverting a slurry byproduct from the top surface of the polishing pad;

a slurry catcher for receiving the slurry byproduct diverted from the top surface of the polishing pad, the slurry catcher being disposed adjacent to the polishing pad and being comprised of a substantially transparent material; and an optical measuring tool for measuring an optical property of the slurry byproduct, the optical measuring tool being disposed below the slurry catcher.

13. The chemical mechanical planarization system of claim 12, wherein the optical measuring tool is a refractometer.

14. The chemical mechanical planarization system of claim 12, wherein a distance the slurry diverter is disposed away from the polishing head is in a range from about 3 inches to about 5 inches.

* * * * *